US006694039B1

(12) United States Patent
Wu

(10) Patent No.: US 6,694,039 B1
(45) Date of Patent: Feb. 17, 2004

(54) LOUDSPEAKER

(75) Inventor: Wei-Chung Wu, Taipei (TW)

(73) Assignee: Meiloon Industrial Co., Ltd., Taipei (TW)

( * ) Notice: Subject to any disclaimer, the term of this patent is extended or adjusted under 35 U.S.C. 154(b) by 0 days.

(21) Appl. No.: 10/350,112

(22) Filed: Jan. 24, 2003

(51) Int. Cl.[7] ..... H04R 25/00
(52) U.S. Cl. ..... 381/426; 181/167; 420/402
(58) Field of Search ..... 381/426, 427, 381/428, 432; 181/167, 168, 169, 170; 420/402, 408

(56) References Cited

U.S. PATENT DOCUMENTS 5,059,390 A * 10/1991 Burleigh et al.

FOREIGN PATENT DOCUMENTS

| | | | | |
|---|---|---|---|---|
| JP | 56-120293 | * | 9/1981 | |
| JP | 56-164700 | * | 12/1981 | |
| JP | 57-61398 | * | 4/1982 | ..... 420/402 |
| JP | 57-61399 | * | 4/1982 | ..... 420/402 |
| JP | 57-97796 | * | 6/1982 | |
| JP | 57-148494 | * | 9/1982 | ..... 181/167 |
| JP | 58-161495 | * | 9/1983 | |

* cited by examiner

*Primary Examiner*—Sinh Tran
(74) *Attorney, Agent, or Firm*—Troxell Law Office PLLC

(57) ABSTRACT

A loudspeaker having a cone made of magnesium-lithium alloy, comprising of a frame structure, having an expanded opening disposed at the front end and a magnetic element disposed at the rear end; a voice coil, disposed in the middle of the magnetic element; an damper, adhering to the voice coil; a cone, disposed on the inner diameter of the expanded opening of the frame structure and adhering to the voice coil; characterized in that the cone of the loudspeaker is formed by stamping the magnesium-lithium alloy under normal temperature, and the characteristics of the magnesium-lithium alloy material and the stamping process to produce the cone of the loudspeaker, which gives a better and planer sound pressure curve, a wider effective bandwidth, and a more beautiful metal color than the cone of the prior art loudspeaker within the audible frequency range.

4 Claims, 5 Drawing Sheets

LOUDSPEAKER

BACKGROUND OF THE INVENTION

1. Field of the Invention

The present invention relates to a loudspeaker having a magnesium-lithium alloy cone and the method of manufacturing the cone by making use of the characteristics and manufacturability of the magnesium-lithium alloy to make a cone of the loudspeaker having high rigidity and moderate internal loss characteristics. The present invention also provides an excellent manufacturability used for the lightweight and high-fidelity loudspeaker cone.

2. Description of the Prior Art

In general, a conventional prior art loudspeaker comprises: a frame structure, having an expanded opening in its front end and a magnetic element at its rear end; a voice coil, disposed in the middle of the magnetic element; a damper, adhering to the voice coil; a cone, disposed on the internal diameter of the expanded opening of the frame structure and adhering to the voice coil; since the appearance is restricted by the limited space, the cones of earlier stage were made of paper, and then polypropylene products gradually showed up. Aluminum metal is used for making cones now.

Two factors have been taken into consideration for selecting the material for making the cone: (1) Rigidity and (2) Internal loss . In mechanical physics, the larger the rigidity of the material, the higher is the relative natural resonant frequency. Therefore, the application of the cone of the loudspeaker in a higher audio frequency will cause distortion to the sound due to the splitting motion of the resonance, and thus giving a wider effective frequency range. For the material with good internal loss, the internal resistance of the material can absorb and eliminate the energy of the resonance quickly. The application of the cone of the loudspeaker with an appropriate internal resistance can obtain a plane sound pressure curve and a more beautiful metal color in the effective frequency range.

At present, most of the materials used in the prior art loudspeakers are unable to take care of both characteristics of the rigidity and the internal loss. For example, although the paper cone of the loudspeaker has excellent internal loss, but its rigidity is not good, such that the effective frequency range is restricted. In practice, paper products require quite a few thickness to be formed; in addition to the limitation on its bulky appearance, the paper product will be moistened and damaged by fungi easily.

Although the aluminum product with better rigidity does not have such shortcoming, the cone made of aluminum metal is a poorer internal loss than the cone made of paper and polypropylene, and thus causing significant distortion to the sound due to the split motion of the resonance in a higher frequency range.

Recently, magnesium alloy is used to make the case of notebook computers due to its characteristics for light weight, high rigidity, good heat dissipation, absorbing electromagnetic wave and capable for being recycled. Therefore, related manufacturers generally accept the magnesium alloy and use it for mass production. The loudspeaker manufacturers also follow and intend to apply magnesium alloy on the cone of the loudspeaker, but the die-casting process has limitation on the thickness of the finished products. Magnesium alloy cannot be used for developing cones of the loudspeaker, since the stamping process of the magnesium alloy sheet is not suitable for such production. It is unable to manufacture and produce the cone under normal temperature because the crystalline grain of magnesium alloy is a Hexagonal Close Pack (HCP) crystal lattice structure and has the poor extendability of the material. It requires high temperature for the manufacturability, and thus relatively increases the cost and endangers the safety of the manufacturing.

In view of the shortcomings of the cone of the prior art loudspeaker, the inventor of the present invention based on years of experience in the related industry conducted extensive research to resolve the aforementioned problem and invented the present invention made of a material having good rigidity and internal loss, providing excellent manufacturability under normal temperature for stamping and forming the cone of loudspeakers.

SUMMARY OF THE INVENTION

The primary objective of the present invention is to provide a material having excellent rigidity and internal loss characteristics as well as easy manufacturability with metal appearance. Such material is applied on the development of the cone of the high-fidelity loudspeaker and to overcome the shortcomings of the prior art material that is unable to take care of both the rigidity and internal loss.

To accomplish the foregoing objectives, the loudspeaker having a magnesium-lithium alloy cone of the present invention comprises a frame structure, having an expanded opening in its front end and a magnetic element at its rear end; a voice coil, disposed in the middle of the magnetic element; a damper, adhering to the voice coil; a cone, disposed on the internal diameter of the expanded opening of the frame structure and adhering to the voice coil; characterized in that the cone of the loudspeaker is formed by stamping the magnesium-lithium alloy under normal temperature, and the characteristics of the magnesium-lithium alloy material and the stamping process to produce the cone of the loudspeaker, which gives a better and a planer sound pressure curve, a wider effective bandwidth, and a more beautiful metal color than the cone of the prior art loudspeaker within the audible frequency range.

BRIEF DESCRIPTION OF THE DRAWINGS

Other features and advantages of the present invention will become apparent in the following detailed description of the preferred embodiments with reference to the accompanying drawings, in which.

DETAILED DESCRIPTION OF THE PREFERRED EMBODIMENTS

Figure 4:
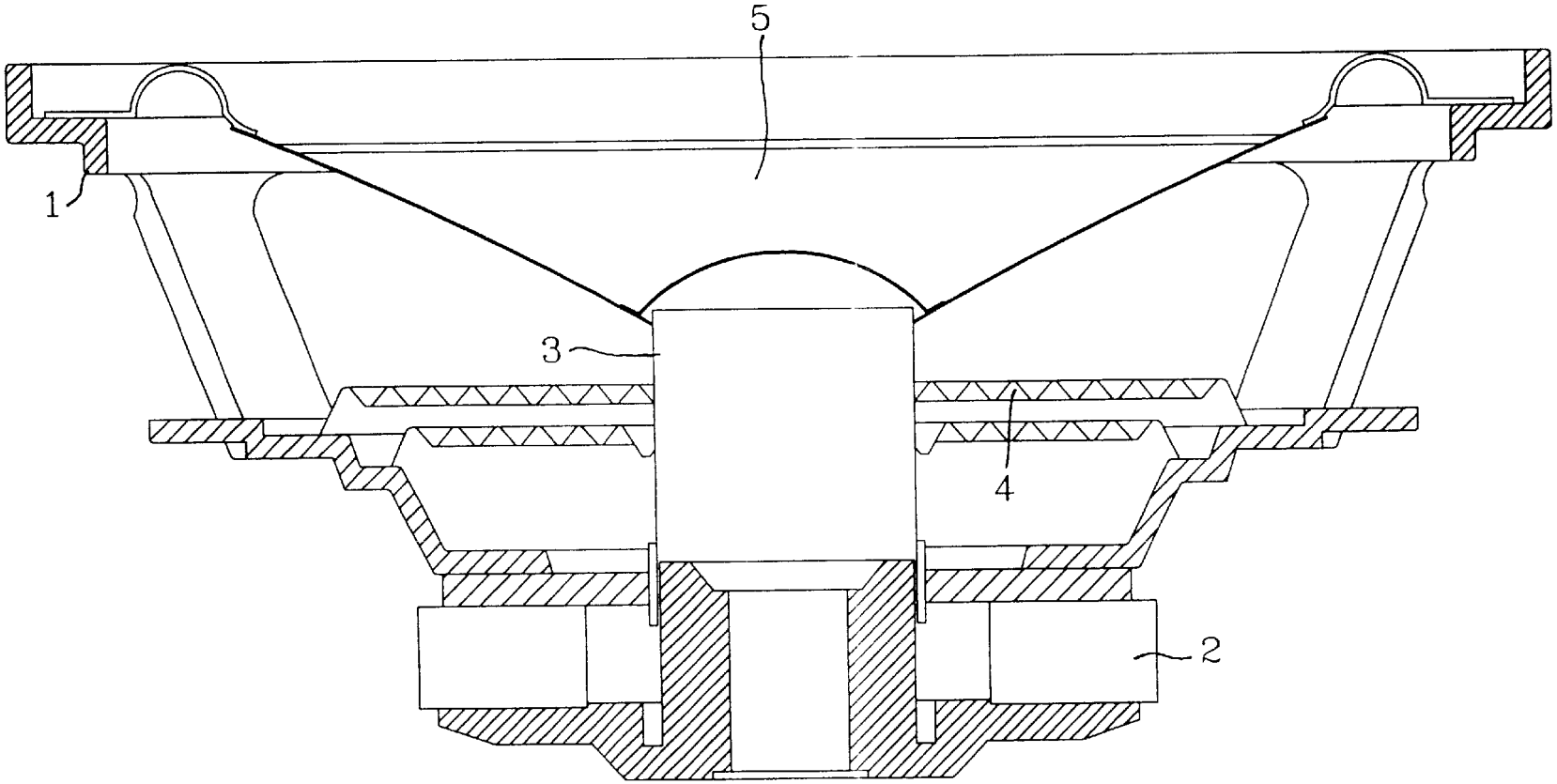
FIG. 4 is an illustrative diagram of an assembled loudspeaker of the present invention.
Figure 5:
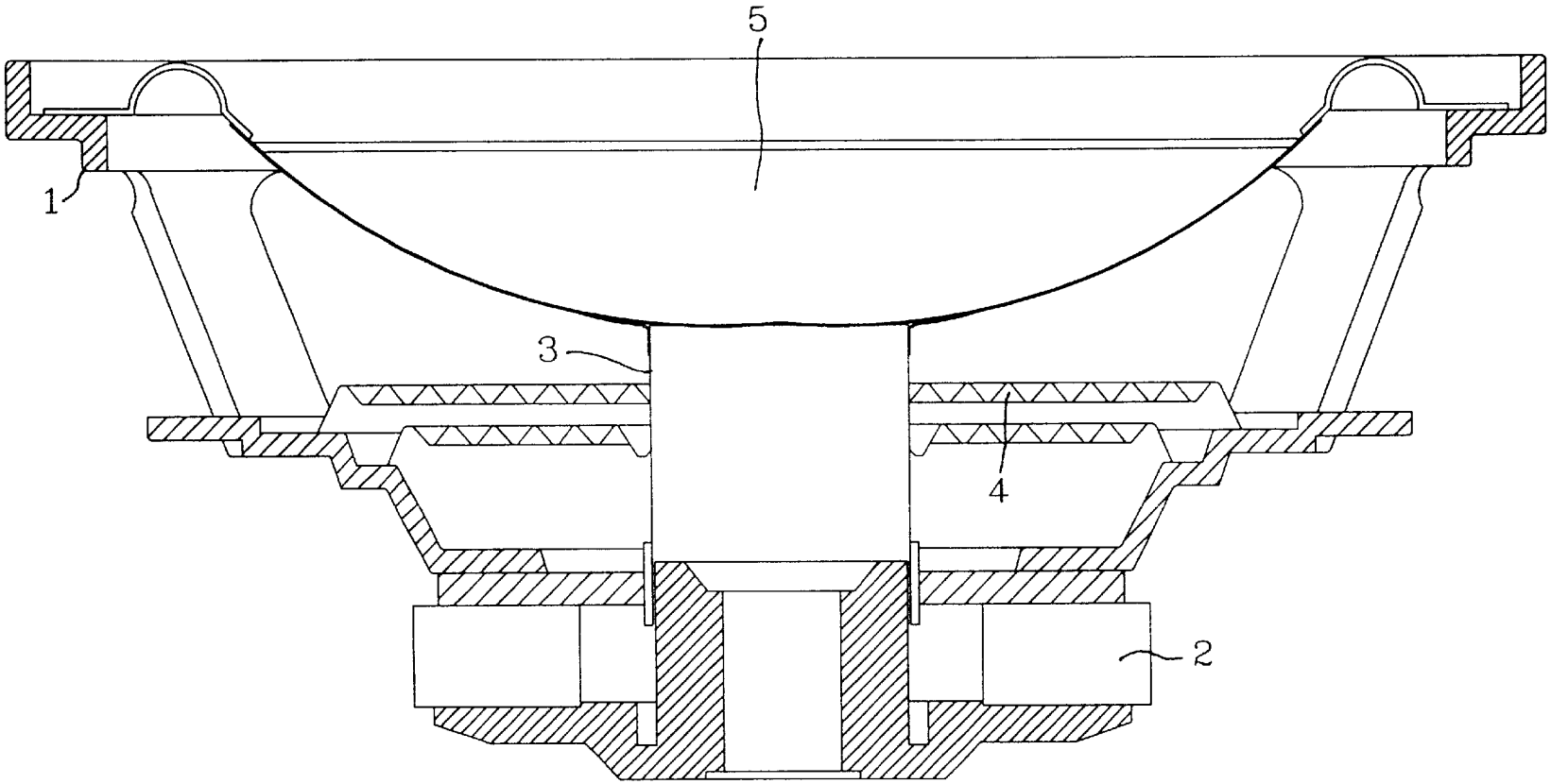
FIG. 5 is an illustrative diagram of another assembled loudspeaker of a preferred embodiment of the present invention.

Please refer to FIGS. 4 and 5 for two models of finished products of the loudspeaker having the magnesium-lithium alloy cone in accordance with the present invention, which comprises: a frame structure 1 having an expanded opening disposed at the front end and a magnetic element 2 disposed at the rear end; a voice coil 3, disposed in the middle of the magnetic element 2; an damper 4, adhering to the voice coil 3; a cone 5 disposed on the inner diameter of the expanded opening of the frame structure 1 and adhering to the voice coil 3; characterized in that the cone 5 is made of a magnesium-lithium alloy having a specific gravity $\rho=1.4\pm15\%$; a tensile strength=197/mm$^2\pm15\%$; specific strength=140±15%; internal loss=34×25%/mm$^2$±15%, and manufactured under normal temperature. Such magnesium-lithium alloy made by adding and smelting a lithium element, and thus the structure of the crystalline granule is converted into Body Centered Cubic (BCC) lattice structure which has the characteristics of high rigidity, moderate internal loss and beautiful metal color, in addition to the its excellent extendability, of which the structure of the prior art paper or aluminum cones is unable to accomplish.

Figure 1:
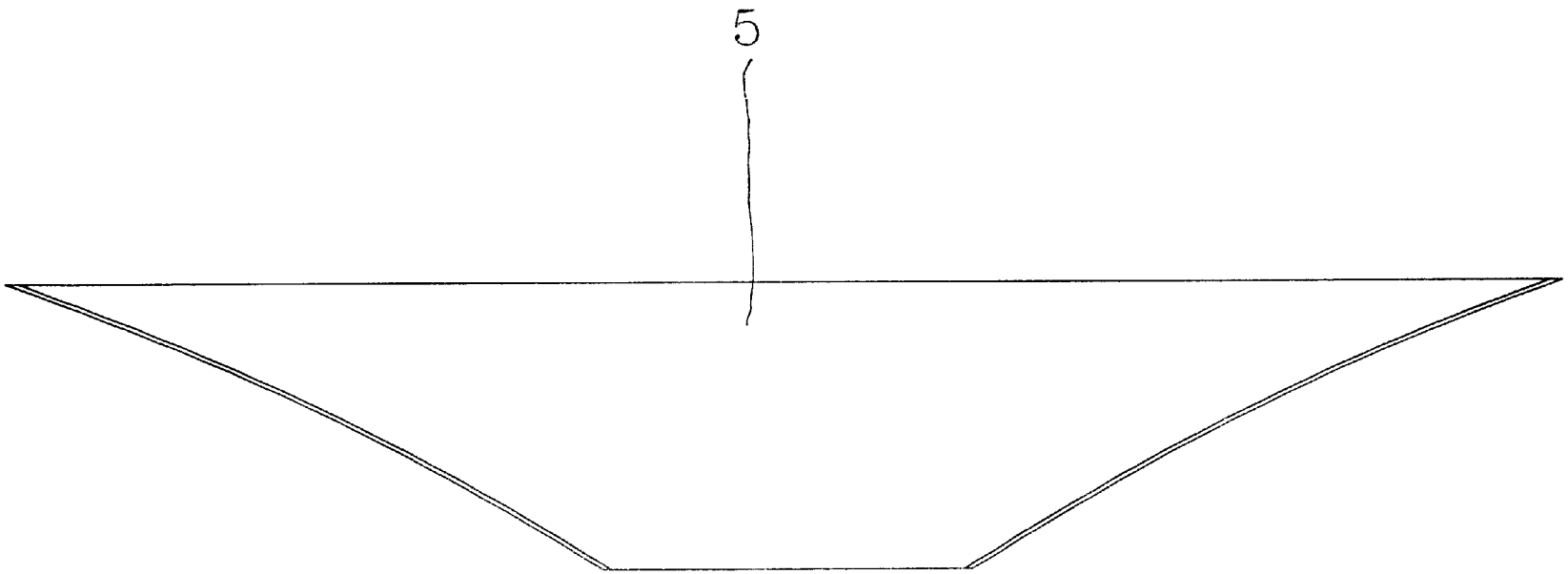
FIG. 1 is an illustrative diagram of the cone of the present invention.
Figure 2:
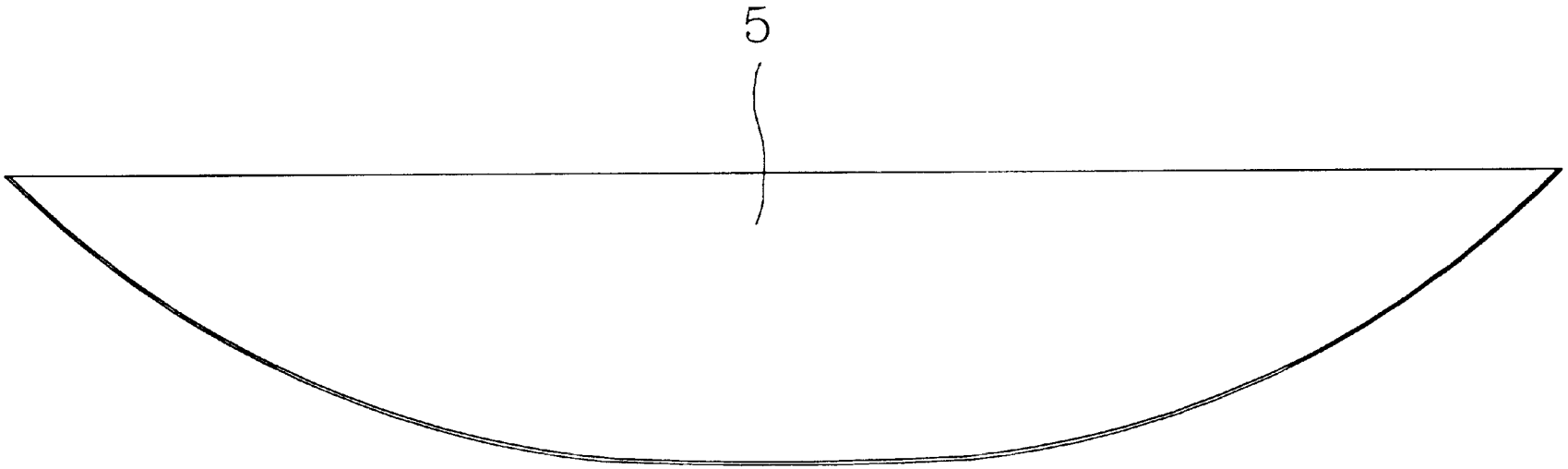
FIG. 2 is an illustrative diagram of the bowl-shaped cone of the present invention.
Figure 3:
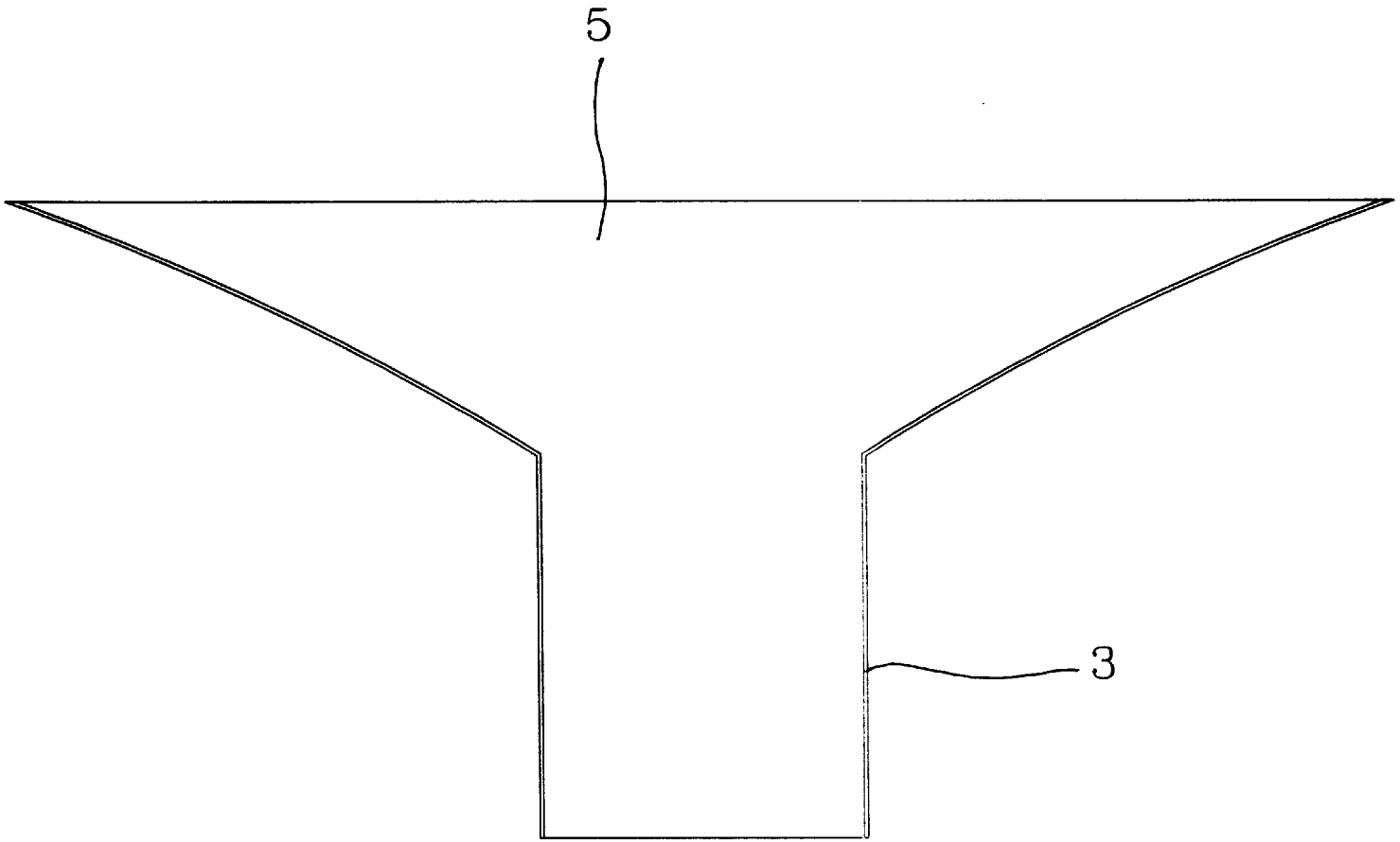
FIG. 3 is an illustrative diagram of the direct integration of the cone and voice coil of the present invention.

In FIGS. 1 to 3, since the finished products have better manufacturability and rigidity, the cone can be manufactured in the shape of a bowl or a cone under normal temperature. Furthermore, during the manufacturing process of the finished products, the cone 5 and the voice coil 3 can be integrated as a whole to save the procedure of gluing the cone 5 with the voice coil 3. Since it is an integral structure, it can effectively enhance the performance, and the components will not be fallen apart easily. What is more, the sound performance is superior to the prior art loudspeaker assembly.

The characteristic of such magnesium-lithium alloy material and the stamping process of making the cone of the loudspeaker give a better and planer sound pressure curve, a wider effective bandwidth, and a more beautiful metal color than the cone of the prior art loudspeaker within the audible frequency range. The comparison of the physical characteristic and manufacturability of the magnesium-lithium finished products, and the current aluminum and magnesium materials are shown as follows:

| | Magnesium Alloy | Aluminum Alloy | Magnesium-Lithium Alloy |
|---|---|---|---|
| Specific Gravity (ρ) | 1.8 | 2.7 | 1.4 |
| Tensile Strength N/m m$^2$ | 234 | 331 | 197 |
| Specific Strength | 130 | 123 | 140 |
| Internal Loss (Vibration Reduction Capacity) 34 N/m m$^2$ | 25% | 1% | 25% |
| Stamping Manufacturability Under Normal Temperature | Poor | Good | Good |

In view of the above description, the present invention can definitely overcome the shortcomings of the conventional cone of loudspeaker, and provide a better performance over the prior art, comply with the patent application requirements, and is submitted to the Patent and Trademark Office for review and granting of the commensurate patent rights.

While the present invention has been described in connection with what is considered the most practical and preferred embodiment, it is understood that the invention is not limited to the disclosed embodiments but is intended to cover various arrangements included within the spirit and scope of the broadest interpretation and equivalent arrangements.

What is claimed is:

1. A loudspeaker, having a magnesium-lithium alloy cone, comprising:

a frame structure, having an expanded opening disposed at the front end and a magnetic element disposed at the rear end;

a voice coil, disposed in the middle of the magnetic element;

an damper, adhering to the voice coil;

a cone, disposed on the inner diameter of the expanded opening of the frame structure and adhering to the voice coil; wherein said cone of the loudspeaker is a magnesium-lithium alloy having a specific gravity ρ=1.4±15%; a tensile strength=197/mm$^2$±15%; specific strength=140±15%; internal loss=34×25%/mm$^2$±15%, and being manufactured by stamping under normal temperature.

2. A loudspeaker as claimed in claim 1, wherein said cone is in a conical shape.

3. A loudspeaker as claimed in claim 1, wherein said cone is in a bowl shape.

4. A loudspeaker as claimed in claim 1, wherein said cone and voice coil are integrated as a whole structure.

* * * * *